US008789373B2

(12) United States Patent
Huth

(10) Patent No.: US 8,789,373 B2
(45) Date of Patent: Jul. 29, 2014

(54) SWIRL GENERATOR, METHOD FOR PREVENTING FLASHBACK IN A BURNER HAVING AT LEAST ONE SWIRL GENERATOR AND BURNER

(75) Inventor: Michael Huth, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 1024 days.

(21) Appl. No.: 12/728,518

(22) Filed: Mar. 22, 2010

(65) Prior Publication Data

US 2010/0236252 A1 Sep. 23, 2010

(30) Foreign Application Priority Data

Mar. 23, 2009 (EP) ..... 09155904

(51) Int. Cl.
*F02C 1/00* (2006.01)

(52) U.S. Cl.
USPC ..... 60/748

(58) Field of Classification Search
USPC ..... 60/737, 740, 742, 748; 239/399, 402, 239/405
See application file for complete search history.

(56) References Cited

U.S. PATENT DOCUMENTS

| | | | | |
|---|---|---|---|---|
| 3,866,413 | A * | 2/1975 | Sturgess | 60/742 |
| 5,675,971 | A * | 10/1997 | Angel et al. | 60/746 |
| 5,778,676 | A | 7/1998 | Angel | |
| 5,865,024 | A | 2/1999 | Joshi | |
| 6,082,111 | A | 7/2000 | Stokes | |
| 6,415,594 | B1 * | 7/2002 | Durbin et al. | 60/772 |
| 6,993,916 | B2 * | 2/2006 | Johnson et al. | 60/776 |
| 2004/0055306 | A1 | 3/2004 | Eng | |
| 2005/0092220 | A1 * | 5/2005 | Okazaki et al. | 110/347 |
| 2008/0280238 | A1 | 11/2008 | Nazeer | |
| 2010/0319350 | A1 * | 12/2010 | Landry et al. | 60/748 |

FOREIGN PATENT DOCUMENTS

| | | | |
|---|---|---|---|
| CN | 85103360 | A | 12/1986 |
| CN | 1282408 | A | 1/2001 |
| CN | 1984851 | A | 6/2007 |
| CN | 101297160 | A | 10/2008 |
| CN | 101377305 | A | 3/2009 |
| DE | 102007004394 | A1 | 10/2007 |
| DE | 102008044448 | A1 | 3/2009 |
| JP | 2005351616 | A | 12/2005 |
| JP | 2007285572 | A | 11/2007 |

* cited by examiner

*Primary Examiner* — Phutthiwat Wongwian

(57) ABSTRACT

A swirl generator, a method for preventing flashback in a burner with a swirl generator and a burner are provided. The swirl generator includes a central fuel distributor element, an outer wall enclosing the central fuel distributor element and bounding an axial flow channel for combustion air, swirl vanes extending in a radial direction to the outer wall and giving the flowing combustion air a tangential flow component, and a separating wall enclosing the central fuel distributor element and being positioned radially within the outer wall. The separating wall divides the flow channel into a radially inner channel segment and a radially outer channel segment. The radially inner channel segment allows the combustion air to pass without giving it a tangential flow component or while giving it a tangential flow component counter to the orientation of the tangential flow component in the radially outer channel segment.

10 Claims, 7 Drawing Sheets

SWIRL GENERATOR, METHOD FOR PREVENTING FLASHBACK IN A BURNER HAVING AT LEAST ONE SWIRL GENERATOR AND BURNER

CROSS REFERENCE TO RELATED APPLICATIONS

This application claims priority of European Patent Office Application No. 09155904.7 EP filed Mar. 23, 2009, which is incorporated by reference herein in its entirety.

FIELD OF INVENTION

The present invention relates to a swirl generator having a central fuel distributor element and a burner having at least one swirl generator. The invention also relates to a method for preventing flashback in a burner, which comprises at least one swirl generator having a central fuel distributor element.

BACKGROUND OF INVENTION

Gas turbine burners having a central fuel distributor element and swirl generators enclosing the fuel distributor elements are described for example in DE 10 2007 004 394 A1, US 2004/0055306 A1 and U.S. Pat. No. 6,082,111. In the burners described in US 2004/055306 A1 and U.S. Pat. No. 6,082,111 the swirl generator extends in each instance from the central fuel distributor element to a wall enclosing the central fuel distributor element and bounding an axial flow channel for combustion air. The burners here each comprise a number of such arrangements. In such burners the profiles of the fuel injected into the flow channel are designed such that only very little fuel is fed to the zone around the central fuel distributor element, so that only a very lean mixture forms in this zone. This is with the intention of preventing flashback. A zone with reduced flow speed therefore results in the vortices, which form on the downstream side of the central distributor element. If too much fuel is now injected in proximity to the central distributor element, it may happen that this central region with low flow speed is supplied with too much fuel, which can result in flashback, which in the event of large loads is associated with very high temperatures downstream of the swirl generator. By diminishing the quality of the mixture, the very lean mixture in the region of the central fuel distributor element causes an increase in $NO_x$ emissions, which however have to be tolerated to prevent flashback.

To prevent flashback it is proposed in DE 10 2007 004 394 A1 that the swirl vanes should be provided with cutouts in proximity to the central fuel distributor element, so that the swirl vanes in proximity to the central fuel distributor element are shorter in an axial direction than those some distance from the distributor element. The curvature of the swirl vanes in a circumferential direction therefore does not extend so far in proximity to the central distributor element as it does some distance from the central distributor element. This means that the air flowing through the flow channel is subject to less swirling in proximity to the distributor element and therefore flows faster in an axial direction than it does further away from the distributor element. A cylindrical wall can also be present in the region of the cutout on the inner edges of the swirl vanes facing the distributor element, separating the channel segment with less vortex formation from the channel segment with greater vortex formation.

SUMMARY OF INVENTION

An object of the present invention is to create an advantageous swirl generator and an advantageous burner compared with the cited prior art. A further object of the present invention is to provide an advantageous method for preventing flashback in a burner having at least one swirl generator.

The above objects are achieved by a swirl generator, a burner and a method for preventing flashback as claimed in the independent claims. The dependent claims contain advantageous embodiments of the invention.

An inventive swirl generator comprises a central fuel distributor element, an outer wall enclosing the central fuel distributor element and bounding an axial flow channel for combustion air, swirl vanes, which extend to the outer wall in a radial direction and give the flowing combustion air a tangential flow component, and a separating wall, which encloses the central fuel distributor element and is positioned radially within the outer wall. The separating wall divides the flow channel into a radially inner channel segment and a radially outer channel segment. The separating wall here can extend in the axial direction of the swirl generator at least over the axial length of the swirl vanes, but also particularly beyond their axial length. The radially inner channel segment allows the combustion air to pass without giving it a tangential flow component or while giving it a tangential flow component counter to the orientation of the tangential flow component in the radially outer channel segment.

The total avoidance of a tangential component in the inner channel region allows a flow enveloping the central fuel distributor element to be generated with a high axial flow speed around said element, which helps to prevent flashback in a reliable manner. However the generation of a counterswirl in the inner channel segment, in other words a swirl, the orientation of which is counter to the swirl in the outer channel segment, can also help to prevent flashback, since it has a positive influence on flow conditions in the vortex downstream of the central fuel distributor element.

The total avoidance of a tangential flow component in the inner channel segment can in particular be achieved by having no swirl vanes at all in this channel segment. To supply the swirl vanes in the radially outer channel segment with fuel, fuel lines can extend through the radially inner channel segment to the swirl vanes in the radially outer channel segment. To prevent flow interruptions at the fuel lines, these advantageously have a circular or teardrop-shaped cross section.

If there are swirl vanes in the radially inner channel segment, which give the combustion air flowing through the radially inner channel segment a tangential flow component, the orientation of which is counter to the tangential flow component in the radially outer channel segment, the fuel lines for the swirl vanes in the radially outer channel segment can extend through the swirl vanes in the radially inner channel segment, for example in the form of holes drilled through the swirl vanes.

In order to achieve a particularly uniform fuel profile in the inner channel segment, it is advantageous if there are fuel outlet openings in the fuel lines or swirl vanes in the inner channel segment. These can in particular be disposed so that they inject the fuel into the combustion air essentially perpendicular to the flow direction of the combustion air in the radially inner channel segment. Fuel outlet openings can similarly be present in the swirl vanes in the radially outer channel segment and these can in particular be disposed so that they inject the fuel into the combustion air essentially perpendicular to the flow direction of the combustion air in the radially outer channel segment. This also allows a uniform fuel profile to be achieved in the radially outer channel segment. However the injection direction does not necessarily have to be perpendicular to the flow direction of the combustion air. Rather the injection direction can in principle be selected freely. Alternatively or additionally to being supplied perpendicular to the flow direction of the combustion air, the fuel can therefore also be supplied for example perpendicular to the radial direction and/or counter to the flow direction of the combustion air flowing through the flow channel and/or parallel to the flow direction of the combustion air flowing through the flow channel. Other directions and combinations, which are not mentioned specifically, are also possible. This applies both to the fuel supply in the inner channel segment and to the fuel supply in the outer channel segment.

In order to increase the axial flow speed further in proximity to the central fuel distributor element, the separating wall can at least partially have a conical form, with the opening cross section of the radially inner channel segment decreasing in the flow direction of the combustion air.

In one development of the inventive swirl generator the separating wall projects out beyond the downstream end of the outer wall. This development can be realized both with a conically configured separating wall and with a separating wall that is not configured conically.

The relatively complicated geometric form of the inventive swirl generator compared with swirl generators according to the prior art can be realized advantageously, if the swirl generator is embodied as a cast part. If a casting model is first produced, the production costs for the inventive swirl generator as a cast part are not very different from the production costs for the swirl generator according to the prior art.

An inventive burner is equipped with at least one inventive swirl generator. This allows the advantages described with reference to the swirl generator to be achieved in a burner, which can in particular be a gas turbine burner.

According to the invention a method is also provided for preventing flashback in a burner, which comprises at least one swirl generator having a central fuel distributor element and an outer wall enclosing the central fuel distributor element and bounding an axial flow channel for combustion air. The combustion air flowing through the flow channel is given a tangential flow component in a radially outer channel region. In contrast in a radially inner region the combustion air flowing through the flow channel is not given a tangential flow component or is given a tangential flow component counter to the tangential flow component in the radially outer channel region.

The advantages that can be achieved with the inventive method in respect of preventing flashback have already been described in relation to the inventive swirl generator. Reference is made to this description to avoid repetition.

A particularly uniform fuel profile can be produced, if the fuel is supplied to the combustion air flowing through the flow channel. The fuel can be mixed in here in particular perpendicular to the flow direction of the combustion air flowing through the flow channel and/or perpendicular to the radial direction. Alternatively or in addition to the above-mentioned variants it can also be mixed in essentially counter to the flow direction of the combustion air flowing through the flow channel and/or parallel to the flow direction of the combustion air flowing through the flow channel.

BRIEF DESCRIPTION OF THE DRAWINGS

Further features, characteristics and advantages of the present invention will emerge from the description which follows of exemplary embodiments with reference to the accompanying figures, in which.

DETAILED DESCRIPTION OF INVENTION

Figure 1:
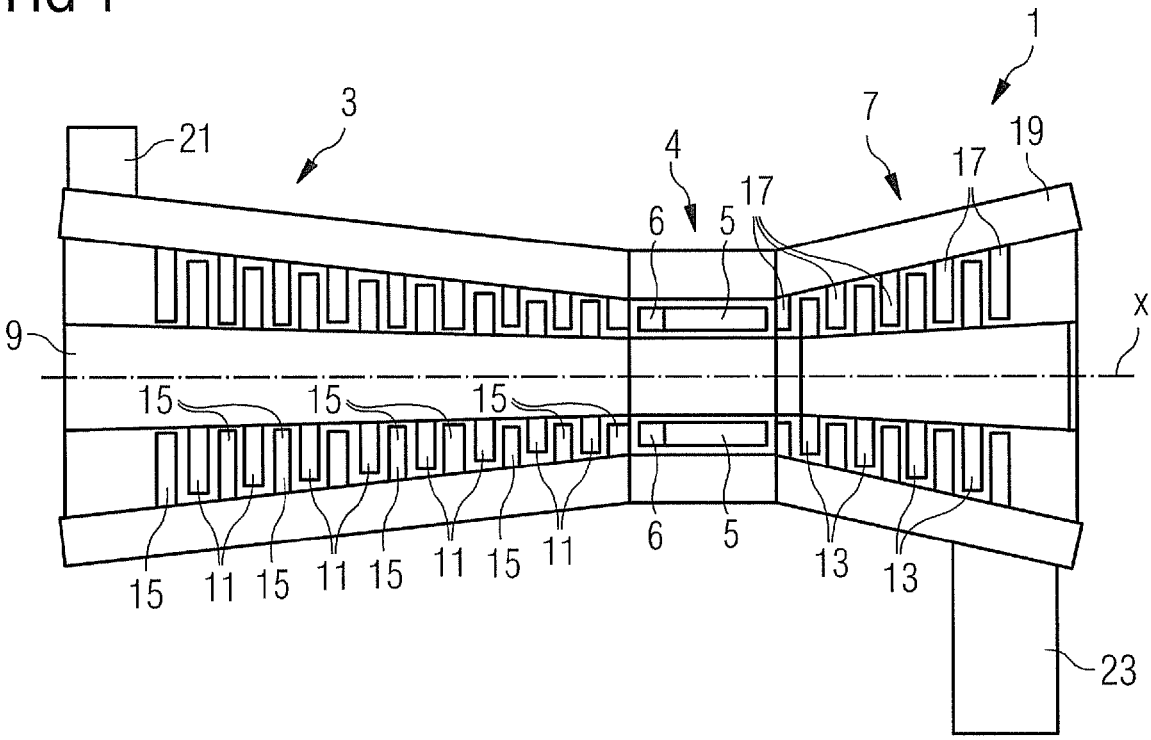
FIG. 1 shows a highly schematic diagram of a gas turbine.

The structure and function of a gas turbine are described below with reference to FIG. 1, which shows a highly schematic sectional view of a gas turbine. The gas turbine 1 comprises a compressor segment 3, a combustion segment 4, which in the present exemplary embodiment comprises a number of tubular combustion chambers 5 with burners 6 disposed thereon, but in principle can also comprise an annular combustion chamber, and a turbine segment 7. A rotor 9 extends through all the segments and in the compressor segment 3 supports compressor blade rings 11 and in the turbine segment 7 supports turbine blade rings 13. Rings of compressor vanes 15 and rings of turbine vanes 17 are disposed between adjacent compressor blade rings 11 and between adjacent turbine blade rings 13, extending from a housing 19 of the gas turbine 1 radially outward in the direction of the rotor 9.

During operation of the gas turbine 1 air is drawn in through an air inlet 21 into the compressor segment 3. The air is compressed here by the rotating compressor blades 11 and routed to the burners 6 in the combustion segment 4. In the burners 6 the air is mixed with a gaseous or liquid fuel and the mixture is combusted in the combustion chambers 5. The hot combustion waste gases, which are at high pressure, are then fed to the turbine segment 7 as a working medium. On their way through the turbine segment the combustion waste gases transmit a pulse to the turbine blades 13, causing them to decompress and cool. The decompressed and cooled combustion waste gases finally leave the turbine segment 7 through an exhaust 23. The transmitted pulse produces a rotational movement of the rotor, which drives the compressor and a consumer, for example a generator to produce electrical current or an industrial machine. The rings of turbine vanes 17 serve here as nozzles for conducting the working medium, to optimize the pulse transmission to the turbine blades 13.

Figure 2:
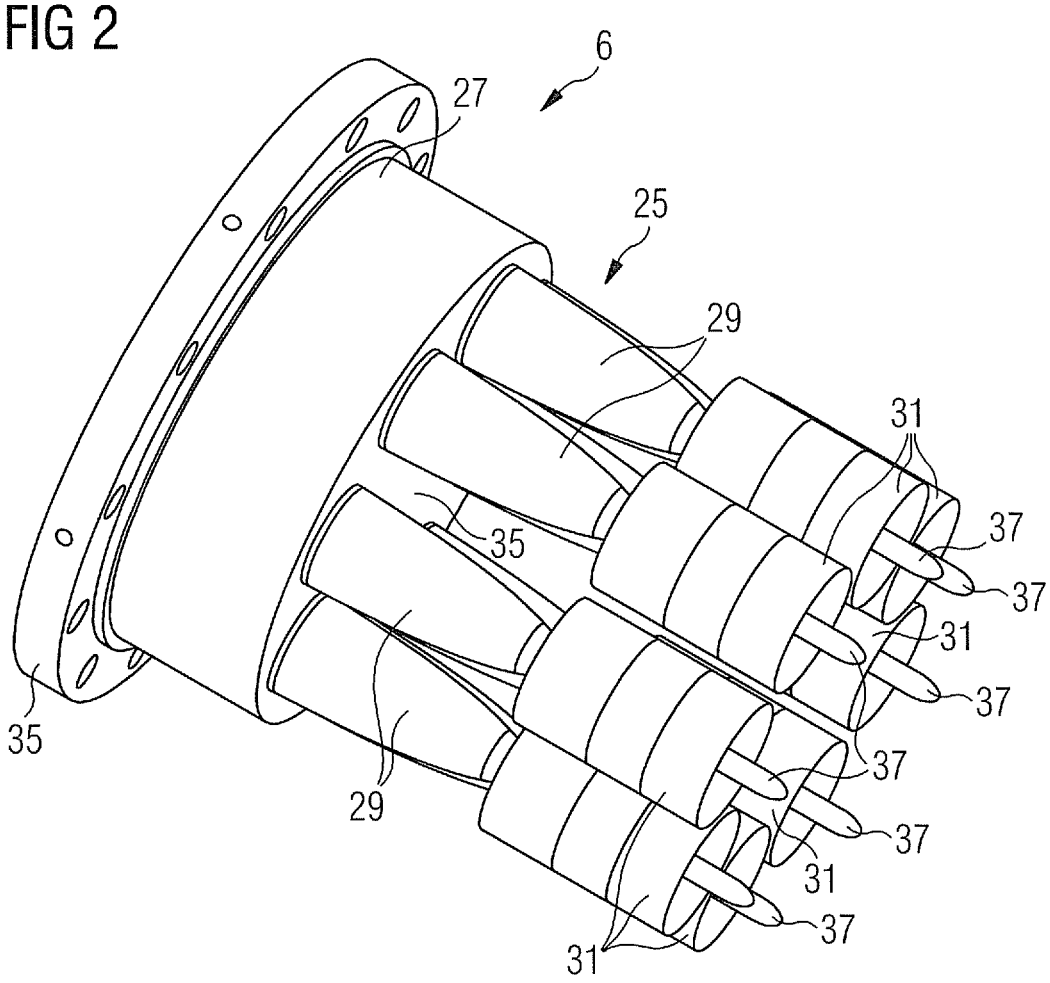
FIG. 2 shows a perspective view of a gas turbine burner.

FIG. 2 shows a perspective view of a burner 6 of the combustion segment 4. As its main components the burner 6 comprises a fuel distributor 27, eight fuel nozzles 29, which extend out from the fuel distributor 27, and eight swirl generators 31 disposed in the region of the tips of the fuel nozzles 29. The fuel distributor 27 and the fuel nozzles 29 together form a burner housing, through which fuel lines extend to injection openings, which are disposed within the swirl generator 31 and are therefore not visible in FIG. 2. The burner can be connected to fuel supply lines by way of a number of sockets (not shown). A flange 35 secures the burner 6 to a tubular combustion chamber so the fuel nozzles 29 point toward the interior of the combustion chamber.

Although the burner 6 shown in FIG. 2 has eight fuel nozzles 29, it is also possible to equip it with another number of fuel nozzles 29. The number of fuel nozzles here can be higher or lower than eight, for example six fuel nozzles or twelve fuel nozzles can be present, each having its own swirl generator. A pilot fuel nozzle is also generally disposed in the center of the burner. The pilot fuel nozzle is not shown in FIG. 2 for purposes of clarity.

During the combustion process air from the compressor is conducted through the swirl generator 31, where it is mixed with fuel. The air/fuel mixture is then combusted in the combustion zone of the combustion chamber 5 to form the working medium.

Figure 3:
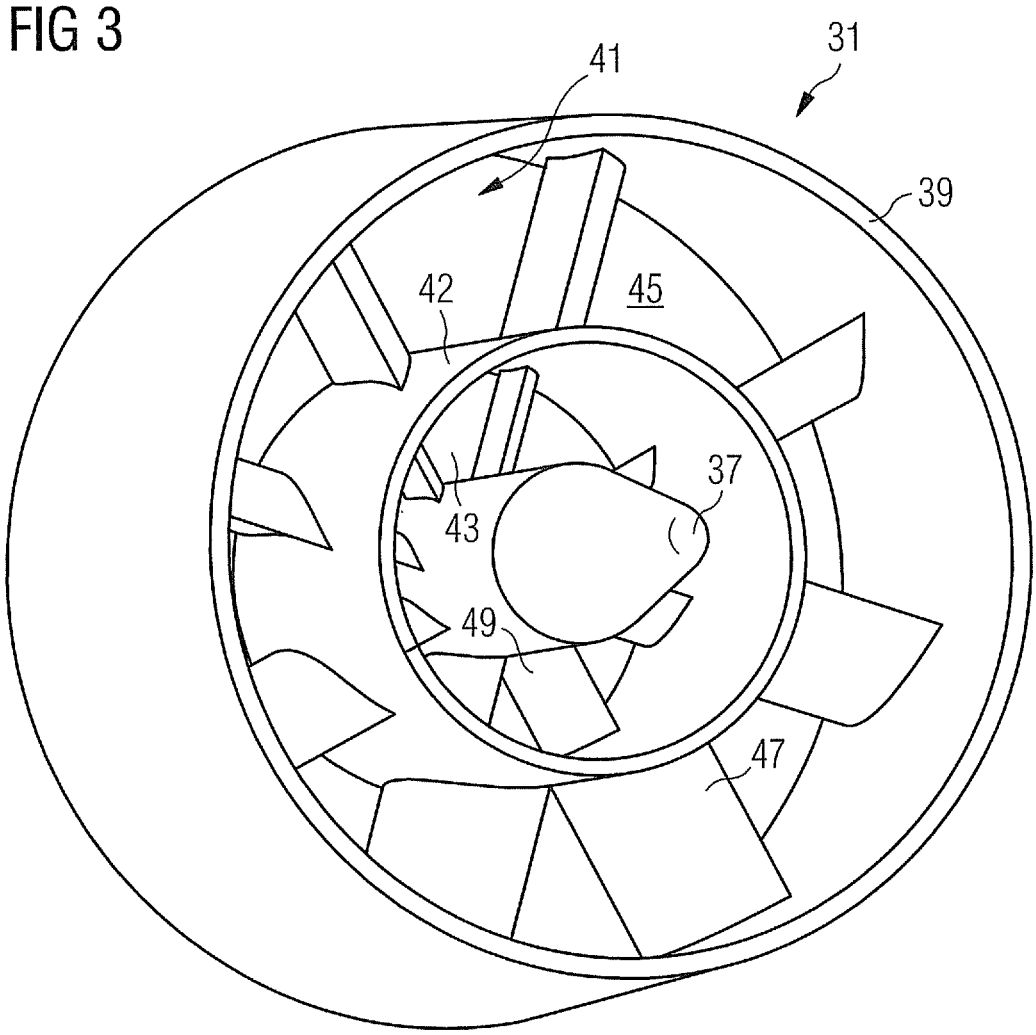
FIG. 3 shows a perspective view of a swirl generator of the burner from FIG. 2.

FIG. 3 shows a perspective view of a swirl generator of the burner 6. The swirl generator 31 has a central fuel distributor element 37, which is enclosed by an outer wall 39, which forms an axial flow channel for compressor air. A separating wall 42, which encloses the central fuel distributor element 37 and is positioned radially within the outer wall 39, is also present in the flow channel 41 to divide the flow channel 41 into a radially inner channel segment 43 and a radially outer channel segment 45. Swirl vanes 47 extend out from the separating wall 42 in a radial direction through the radially outer channel segment to the outer wall 39. The swirl vanes 47 give the compressor air flowing through the radially outer channel segment 45 a tangential flow component, so the air forms a vortex after passing through the swirl generator 31.

Figure 4:
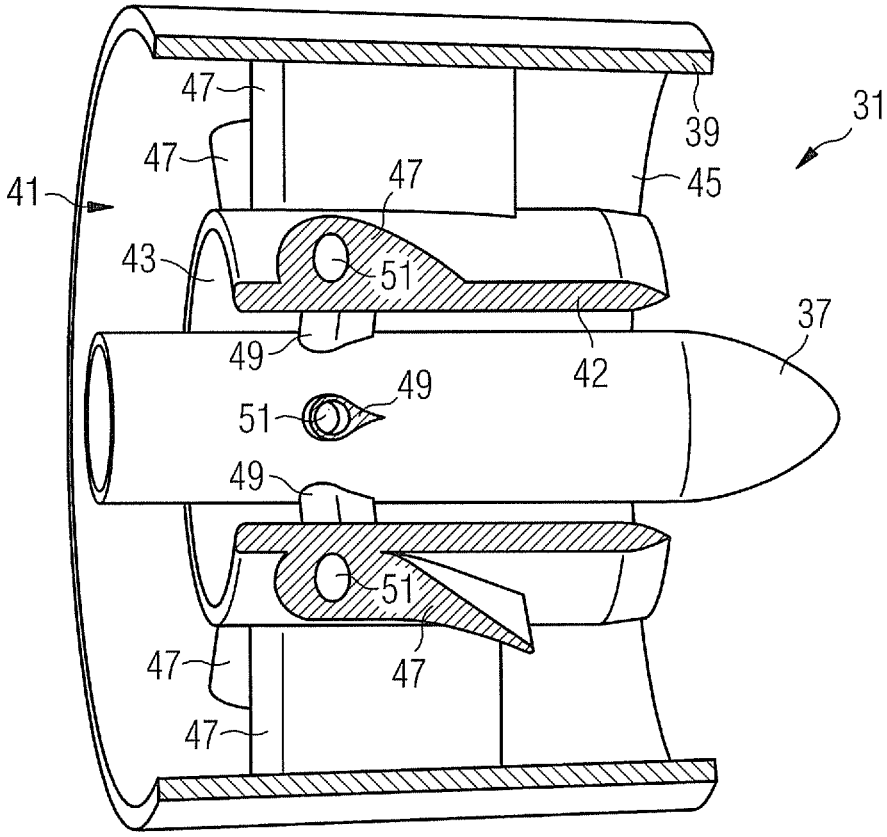
FIG. 4 shows a partial section of the swirl generator from FIG. 3.

No swirl vanes are present in the radially inner channel segment 43. Instead fuel lines 49 extend out from the central fuel distributor element 37 in a radial direction to the separating wall 42. As is evident in particular in FIG. 4, which shows a partial section of the swirl generator 31, the fuel lines 49 have a teardrop-shaped cross section, to prevent the flow being interrupted at the downstream edge of the lines 49. However the lines 49 could in principle also have a round cross section instead of a teardrop shaped cross section.

Figure 5:
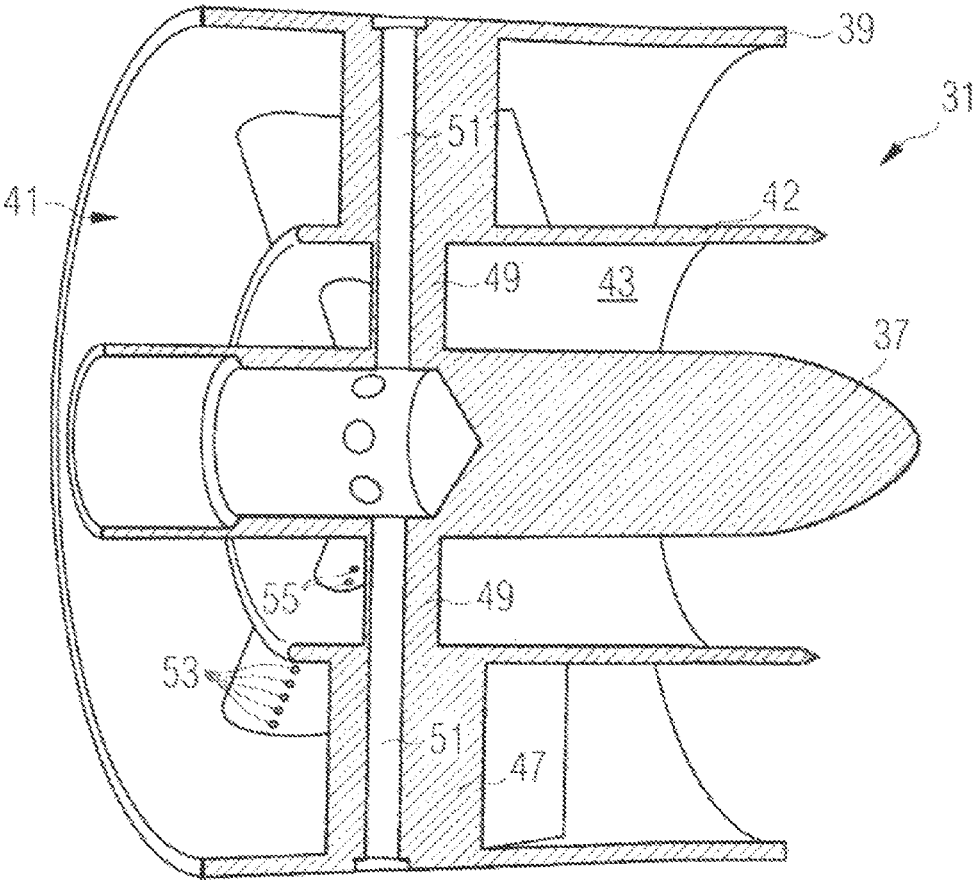
FIG. 5 shows a section of the swirl generator from FIG. 3 along its longitudinal axis.

The fuel lines 49 are disposed so that they are flush with the swirl vanes 47 in the radially outer channel segment, so that a fuel channel 51 can extend straight out from the central fuel distributor element 37 through the fuel lines 49 into the swirl vanes 47. The fuel channels 51 can be seen in particular in FIG. 5, which shows a sectional view through the swirl generator 31 along its longitudinal axis. The fuel channels 51 are used to supply fuel to outlet openings 53 in the swirl vanes 47 and outlet openings 55 in the fuel lines 49. The outlet openings 53, 55 here are disposed so that the fuel is injected into the radially outer channel segment 45 and the radially inner channel segment 43 essentially perpendicular to the flow direction of the compressor air.

The described swirl generator design means that the compressor air flowing through the radially inner channel segment 43 is not given any swirl. The flow speed of this compressor air in an axial direction is therefore greater than the speed of the compressor air flowing through the radially outer channel segment 45, in which some of the axial flow is converted to a tangential flow component. The higher axial flow speed in the radially inner channel segment, i.e. in the region adjacent to the central fuel distributor element 37, prevents the occurrence of zones with a low axial flow speed downstream of the central fuel distributor element 37, which in turn prevents flashback. This allows more fuel to be injected in proximity to the central distributor element 37 compared with the prior art, thereby reducing $NO_x$ emissions during combustion.

The separating wall 42 extends at least over the entire axial length of the swirl vanes 47 in the radially outer channel segment 45, so that the introduction of a tangential flow component in the radially inner channel segment 43 can be reliably prevented. In the present exemplary embodiment the separating wall 42 also extends in an axial direction beyond the upstream and downstream edges of the swirl vanes 47, to prevent the compressor air flowing through the radially inner channel segment 43 being influenced by the eddying air flowing in the radially outer channel segment 45.

Figure 6:
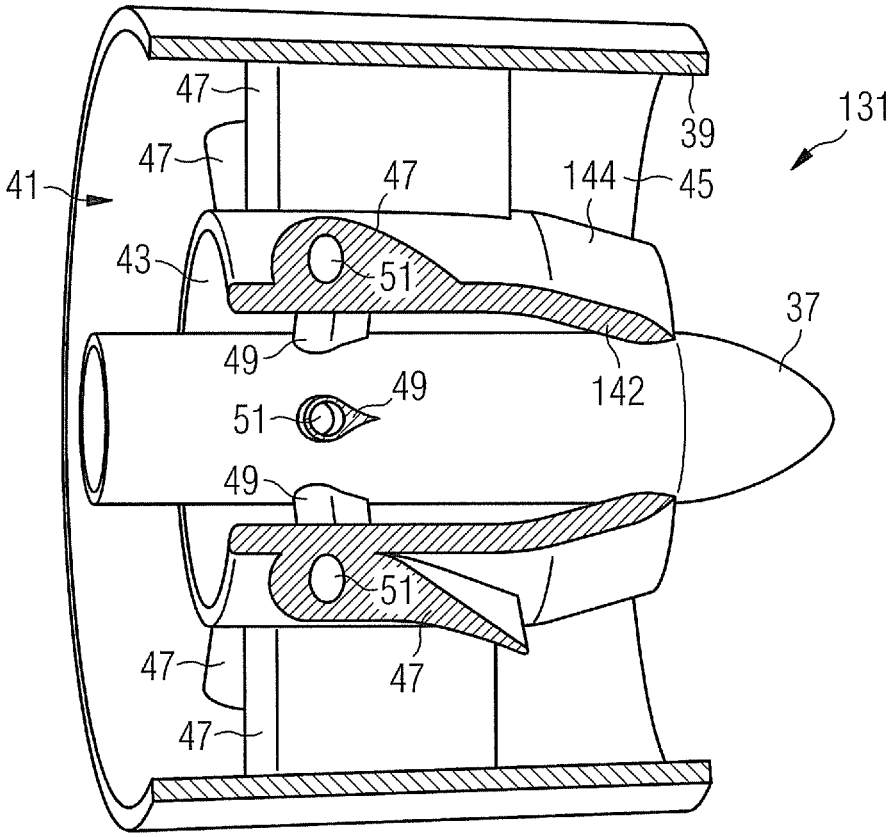
FIG. 6 shows a partial section of an alternative embodiment of the swirl generator.

An alternative variant of the swirl generator 31 is shown in FIG. 6. Elements, which correspond to the swirl generator from the first exemplary embodiment, are identified in FIG. 6 with the same reference characters as in the first exemplary embodiment and are not described again to avoid repetition.

The swirl generator 131 of the second exemplary embodiment differs from the swirl generator 31 of the first exemplary embodiment only by its separating wall 142. In contrast to the first exemplary embodiment the separating wall 142 of the second exemplary embodiment has a conical segment 144, which means that the cross section of the opening of the radially inner channel segment 43 decreases toward the outlet of the swirl generator 131. The conical segment 144 causes the flow speed of the compressor air flowing through the radially inner channel segment 43 to be higher compared with the swirl generator 31 in the first exemplary embodiment. The central fuel distributor element 37 is thus enclosed by an air jacket, which has a particularly high axial flow speed and is thus able to prevent the formation of regions with low flow speed and the associated formation of flashback in a particularly reliable manner.

Although the separating wall 142 in the present exemplary embodiment only has a conical segment 144 on the downstream side, it can also be configured in a conical manner over its entire length.

Figure 7:
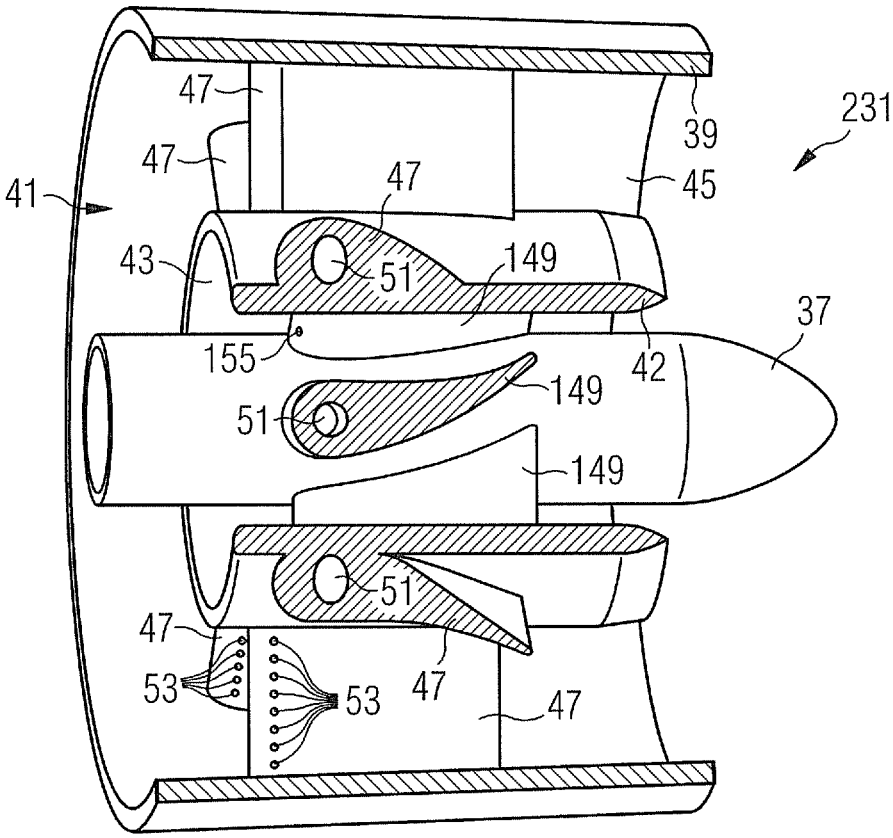
FIG. 7 shows a partial section of a further embodiment of the swirl generator.

A partial section of a third variant of the inventive swirl generator is shown in FIG. 7. As with the swirl generator of the second exemplary embodiment, with the swirl generator of the third exemplary embodiment all the elements that do not differ form the first exemplary embodiment are identified with the same reference characters as in the first exemplary embodiment and are not described again.

The swirl generator 231 of the third exemplary embodiment differs from the swirl generator of the first exemplary embodiment in that swirl vanes 149 are also present in the radially inner channel segment 43. In contrast to the swirl vanes 47 in the radially outer channel segment 45 however, the intake and pressure sides of the vanes are reversed, so that the compressor vanes 159 give the compressor air in the radially inner channel segment a tangential component, which has a reverse orientation in respect of the axial flow direction compared with the tangential component given to the compressor air in the radially outer channel segment 45 by the swirl vanes 47 there. This measure also prevents flashback. Like the fuel lines 49 in the first two exemplary embodiments, the swirl vanes 149 in the radially inner channel segment 43 have fuel channels 51 and fuel outlet openings 155, which are disposed so that they inject the fuel essentially perpendicular to the flow direction of the air flowing through the radially inner channel segment 43.

Although the swirl generator 231 of the third exemplary embodiment in FIG. 7 is shown with a cylindrical separating wall 42, the swirl generator according to the third exemplary embodiment can also be equipped with an at least partially conical separating wall, as described in relation to the second exemplary embodiment.

In the exemplary embodiments shown in the figures the separating walls do not project beyond the downstream end of the respective outer wall. However the separating walls can also be extended on the downstream side—unlike in the figures—so that they project beyond the downstream end of the outer wall. This applies whether or not a separating wall is configured as conical.

The relatively complex geometric form of the swirl generators according to the exemplary embodiments described can be advantageously achieved, if the swirl generators are produced as cast parts.

The invention claimed is:

1. A swirl generator, comprising:

a central fuel distributor element;

an outer wall enclosing the central fuel distributor element and bounding an axial flow channel for combustion air;

a separating wall enclosing the central fuel distributor element and being positioned radially within the outer wall, the separating wall dividing the flow channel into a radially inner channel segment and a radially outer channel segment; and swirl vanes arranged in the radially outer channel segment and extending in a radial direction to the outer wall and giving the flowing combustion air a tangential flow component, wherein, during combustion, the combustion air passes the radially inner channel segment without a tangential flow component, and wherein fuel lines extend through the radially inner channel segment to the swirl vanes in the radially outer channel segment.

2. The swirl generator as claimed in claim 1, wherein the separating wall extends in an axial direction at least over the axial length of the swirl vanes.

3. The swirl generator as claimed in claim 1, wherein the swirl vanes are only present in the radially outer channel segment.

4. The swirl generator as claimed in claim 1, wherein the fuel lines have a circular or teardrop-shaped cross section.

5. The swirl generator as claimed in claim 1, further comprising:

fuel outlet openings in the fuel lines.

6. The swirl generator as claimed in claim 1, further comprising:

fuel outlet openings in the swirl vanes in the radially outer channel segment.

7. The swirl generator as claimed in claim 1, wherein the separating wall at least partially has a conical form, with an opening cross section of the radially inner channel segment decreasing in the flow direction of the combustion air.

8. The swirl generator as claimed in claim 1, wherein the separating wall projects beyond the downstream end of the outer wall.

9. The swirl generator as claimed in claim 1, wherein the swirl generator is a cast part.

10. A burner, comprising:

a swirl generator, the swirl generator comprising a central fuel distributor element;

an outer wall enclosing the central fuel distributor element and bounding an axial flow channel for combustion air;

a separating wall enclosing the central fuel distributor element and being positioned radially within the outer wall, the separating wall dividing the flow channel into a radially inner channel segment and a radially outer channel segment; and swirl vanes arranged in the radially outer channel segment and extending in a radial direction to the outer wall and giving the flowing combustion air a tangential flow component, wherein, during combustion, the combustion air passes the radially inner channel segment without a tangential flow component, wherein fuel lines extend through the radially inner channel segment to the swirl vanes in the radially outer channel segment.

* * * * *